United States Patent [19]

Early et al.

[11] Patent Number: 4,934,562

[45] Date of Patent: Jun. 19, 1990

[54] COVER CONSTRUCTION FOR WASTE CONTAINERS

[75] Inventors: Stephen R. Early, Olathe; Del E. Walker, Lake Quivira, both of Kans.; Freddie L. Selby, Liberty, Mo.; Edward G. Spanknoble, Olathe, Mo.; Orville E. Blume, St. Joseph, Mo.; Michael R. O'Hanlon, Kansas City, Mo.

[73] Assignee: Aero Transportation Products, Kansas City, Mo.

[21] Appl. No.: 254,157

[22] Filed: Oct. 6, 1988

[51] Int. Cl.[5] ..... B65D 85/58; B65D 83/04

[52] U.S. Cl. ..... 220/1.5; 220/1 T; 220/331

[58] Field of Search ..... 220/1 T, 1.5, 331, 329

[56] References Cited

U.S. PATENT DOCUMENTS 1,737,411 2/1929 Deans ..... 220/331

4,653,662 3/1987 Wise ..... 220/1 T 4,821,902 4/1989 May ..... 220/1 T

*Primary Examiner*—Stephen Marcus

*Assistant Examiner*—C. A. Peterson

*Attorney, Agent, or Firm*—Kokjer, Kircher, Bradley, Wharton, Bowman & Johnson

[57] ABSTRACT

A waste container cover which can be vertically raised and lowered to open and close the container and rolled to either side from the open position. The cover has special tracks which ride on rollers to allow side to side movement of the cover. When the cover is above the opening, notches in the tracks are in registration with the rollers. A sliding plate in each track can be slid until inclined slots in the plate register with the notch and allow the cover to lower onto the container to tightly seal it closed. Crank and screw mechanisms operate the sliding plates. The cover can be tipped alongside either side of the container and is then supported in a vertical position by hook shaped levers which bear on pins on the container top.

19 Claims, 3 Drawing Sheets

COVER CONSTRUCTION FOR WASTE CONTAINERS

BACKGROUND OF THE INVENTION

This invention relates generally to the handling and storage of waste materials and more particularly to an improved mechanism for opening and closing a bulk material container such as the type of container that contains hazardous wastes.

Hazardous waste materials such as toxic chemicals and other hazardous substances must be carefully handled in order to prevent possible contamination of the environment and other harmful effects. Chemical wastes and many other materials are handled and disposed of by employing what is known in the industry as intermodal transport. This involves utilization of large containers which contain the waste materials and which may be transferred to and from railcars and truck beds. The waste material is transported in the container from the area at which it is generated to a disposal location which may be distant from the generation site.

The wastes are normally loaded into the container by a front end loader or other equipment, and it is necessary for the container to have a large opening in its top so that loading and unloading can be carried out efficiently. At the same time, it is necessary for the opening to be tightly closed during transport to prevent the hazardous material from leaking out and also to prevent moisture form reaching the material in the container and possibly creating a leaching effect.

Therefore, the container must be equipped with a cover that can effectively seal the opening closed and yet be opened in a manner to fully expose the opening during the loading and unloading operations. The cover must also be lightweight to facilitate its opening and closing, and it must be strong enough to withstand the loads to which it is subjected while in service.

SUMMARY OF THE INVENTION

The present invention is directed to an improved cover construction for a waste container or other bulk container having a large top opening through which materials are loaded and unloaded. In accordance with the invention, a cover panel has a balsa wood core fiberglass construction and is equipped on its underside with special tracks that ride on rollers mounted on top of the container. The tracks and rollers allow the container to be moved from a position over the opening to a position clear of the opening adjacent either side of the container.

The special track construction permits the container to be lowered onto the opening so that it can compress a gasket that provides a seal around the opening. Each track includes two fixed rails and a sliding plate that is sandwiched between the rails. The rails have notches that register with the rollers when the cover is positioned over the opening in the container. Inclined slots are provided in the sliding plates and can be moved into and out of registration with the notches as the plates are slid back and forth. When the slots are moved into registration with the notches, the cover is lowered onto the opening as the notches and slots receive the rollers. A finger projects beneath each slot to form a latch that fits beneath the roller when the cover is fully lowered, thus locking the cover down on the opening.

The sliding plates can be moved to displace the slots from the notches, and the cover is then raised off of the container opening. Each track then presents a continuous edge that rides on the rollers and allows the cover to be moved to either side of the container. The sliding plates are controlled by screw and crank mechanisms that are accessible from both sides of the container.

An additional feature of the invention is a special hook and bar arrangement that allows the cover panel to be tipped to a vertical position along either side of the container while being retained to the container. The cover carries pivotal hooks which catch on pivot bushings located on the container near its opposite sides. When the hooks have been fully engaged with the pivot bushings, the cover can be tipped about the bushings with its weight assisting in the tipping movement. The hooks remain caught on the pivot bushings and support the cover in its vertical position so that the opening is fully exposed and the cover does not interfere with loading or unloading of the container contents. The cover can be tipped back to a horizontal orientation and rolled over the opening again, and the sliding plates can be operated to lower the cover into its closed position where the opening is sealed closed.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
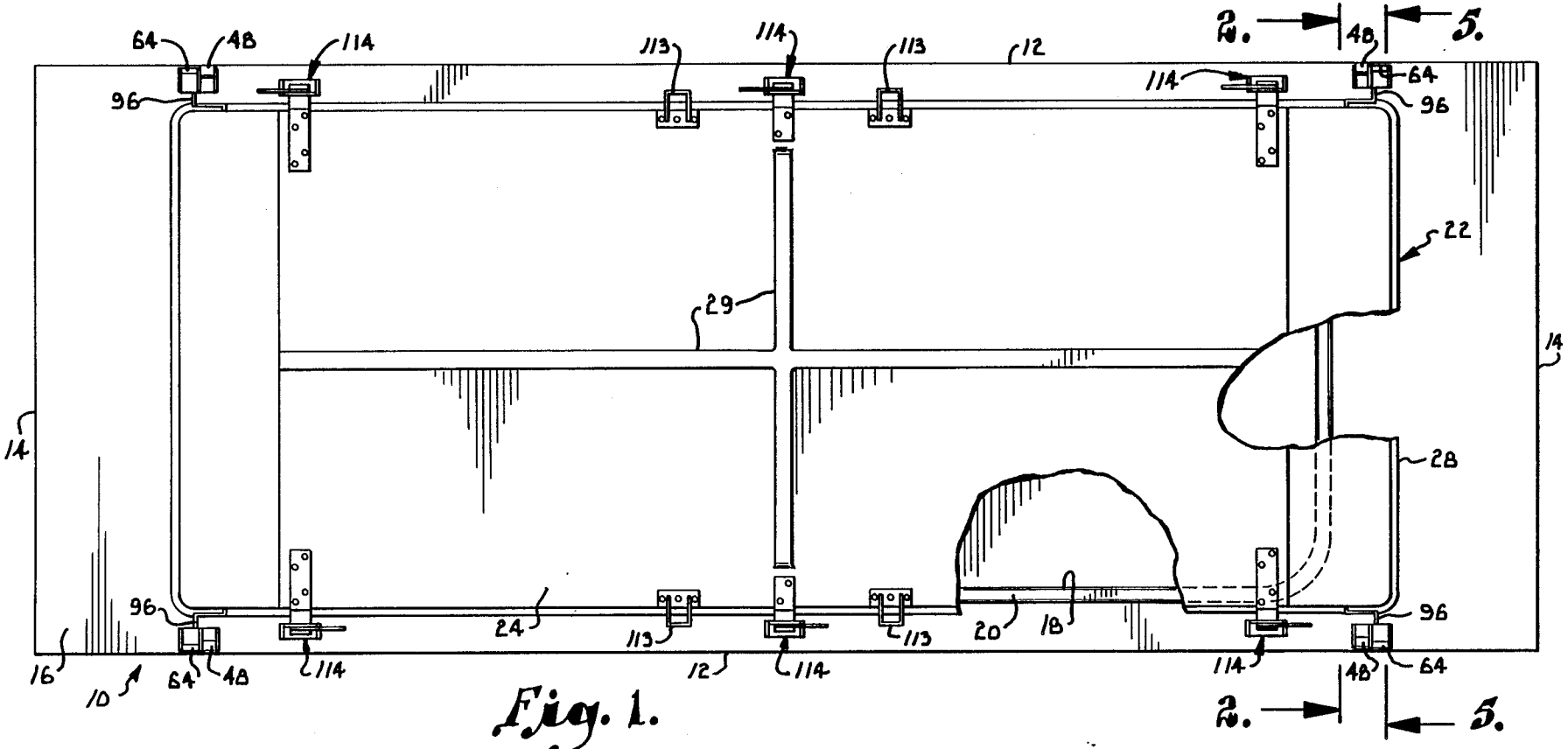
FIG. 1 is a top plan view of a waste container equipped with a cover constructed according to a preferred embodiment of the present invention, with portions of the cover broken away for purposes of illustration.
Figure 2:
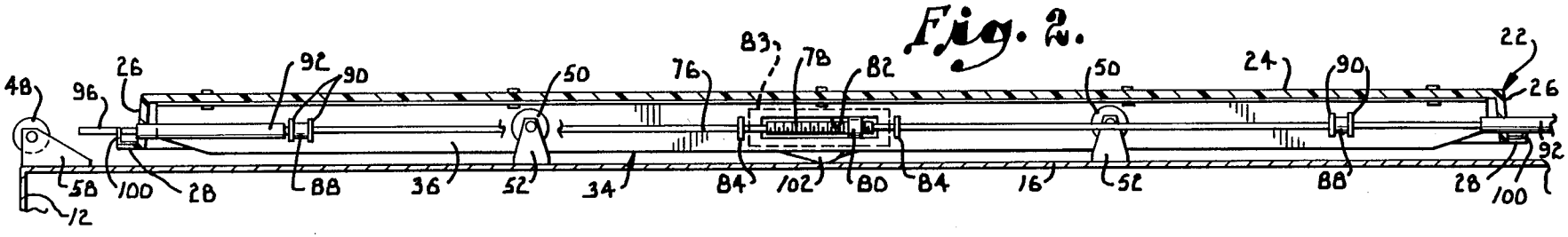
FIG. 2 is a fragmentary sectional view on an enlarged scale taken generally along line 2—2 of FIG. 1 in the direction of the arrows and showing the cover in its closed position on the container opening.

Referring now to the drawings in more detail and initially to FIGS. 1 and 2 in particular, numeral 10 generally designates a bulk container of the type that may be used to receive and transport hazardous waste materials such as toxic chemical wastes and the like. The container 10 has a boxlike configuration and may be transported on a railcar or a truck bed. The container 10 has opposite sides 12, opposite ends 14 and a flat bottom (not shown). The container has a flat top panel 16 which is provided with a generally rectangular opening 18 through which materials can be loaded into and unloaded from the container. The opening 18 is rather large and occupies a large part of the container top. Square tubing 20 is secured to the top panel 16 of the container and extends continuously around the opening 18.

In accordance with the present invention, the container opening 18 may be opened and closed by a cover which is generally identified by reference numeral 22. In order to exhibit high strength characteristics while maintaining a light weight, the cover 22 preferably has a balsa wood core fiberglass construction, although other materials can be used. The cover 22 has a flat, rectangular cover panel 24 and a downturned skirt or flange 26 extending around the periphery of panel 24. A lip 28 extends outwardly from the lower edge of flange 26 around the periphery of the cover 22. The cover 22 may be equipped with ribs 29.

Figure 10:
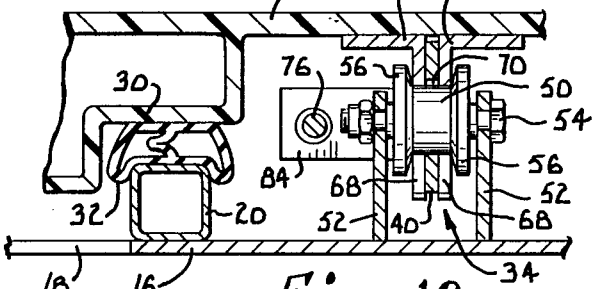
FIG. 10 is a fragmentary sectional view on an enlarged scale taken generally along line 10—10 of FIG. 3 in the direction of the arrows.
Figure 11:
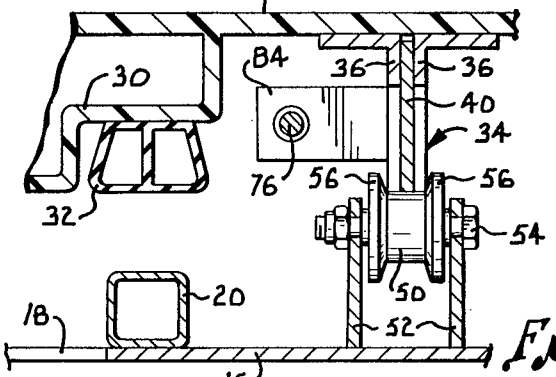
FIG. 11 is a fragmentary sectional view on an enlarged scale taken generally along line 11—11 of FIG. 4 in the direction of the arrows.

As best shown in FIGS. 10 and 11, the underside of the cover panel 24 is provided with a stepped rib 30 which reinforces the cover panel. The rib 30 has a configuration substantially similar to the edge of the opening 18. A compressible gasket 32 is carried on rib 30 and has the same configuration as the tubing 20. Consequently, when the cover panel 24 is lowered onto the opening in the position shown in FIG. 10, gasket 32 is compressed against the tubing 20 and effects a continuous seal around the entirety of the opening 18.

Figure 9:
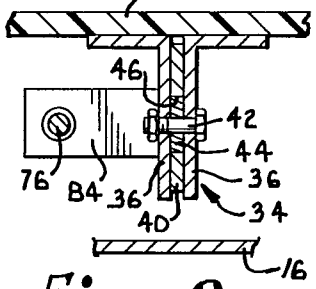
FIG. 9 is a fragmentary sectional view on an enlarged scale taken generally along line 9—9 of FIG. 3 in the direction of the arrows.
Figure 8:
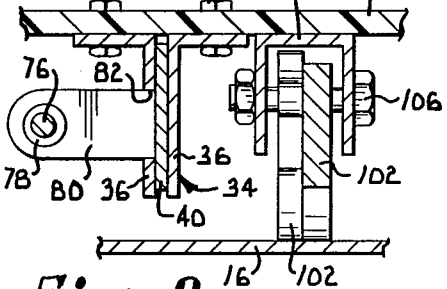
FIG. 8 is a fragmentary sectional view on an enlarged scale taken generally along line 8—8 of FIG. 3 in the direction of the arrows.

In accordance with the present invention, the underside of the cover panel 24 is provided with a pair of specially constructed tracks which are generally identified by numeral 34. The tracks 34 extend across substantially the entire width of the cover panel 24 and are located near the opposite ends of the cover panel. As best shown in FIGS. 8 and 9, each track 34 includes a pair of fixed rails which take the form of steel angles 36. The angles 36 are bolted through their flanges to the underside of the cover panel 24 by bolts 38 (see FIG. 8). Each angle 36 has its longer flange extending generally downwardly from panel 24, and these two flanges of the angles are spaced apart in order to receive between them a sliding plate 40. The plate 40 of each track 34 fits closely between the angles 36 but is supported to slide longitudinally of the track. A plurality of horizontal bolts 42 extend through each pair of angles 36 and mount a guide washer 44 within an elongated slot 46 which is formed in the sliding plate 40. Preferably, each plate 40 is provided with four of the slots 46, and the slots extend horizontally. The washers 44 fit closely in slots 46 and allow the plate 40 to slide back and forth between limiting positions at which the washers 44 engage the ends of the slots 46. The washers 44 retain the sliding plates 40 to the tracks 34 while allowing them to slide between the limiting positions.

The tracks 34 ride on two sets of rollers which are mounted on the top panel 16 of the container 10. The rollers in each set of rollers are arranged in a straight line or row extending along panel 16 slightly beyond the opposite ends of the opening 18. The rollers in each set include a pair of end rollers 48 located at opposite ends of the row of rollers and another pair of rollers 50 which are intermediate rollers spaced apart from one another between the end rollers 48.

As best shown in FIGS. 10 and 11, the intermediate rollers 50 are mounted for rotation between a pair of upstanding plates 52 secured to panel 16. Each roller 50 is mounted to turn about the axis of a horizontal bolt 54 extending between the two plates 52. Opposite ends of each roller 50 are provided with flanges 56 which are spaced apart far enough to allow the track 34 to fit closely between them for rolling movement along the bodies of the rollers.

Figure 12:
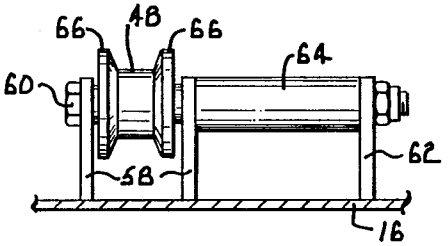
FIG. 12 is a fragmentary elevational view of one of the end rollers taken generally along line 12—12 of FIG. 4 in the direction of the arrows.

As best shown in FIG. 12, each end roller 48 is similar to each intermediate roller 50 secured to panel 16 and is mounted for rotation between a pair of plates 58. Each roller 48 is mounted to rotate about the axis of a horizontal bolt 60 which extends between plates 58 and also through another plate 62. Mounted between plate 62 and the adjacent plate 58 is a cylindrical bushing 64 which is mounted to turn on the bolt 60. Each of the end rollers 48 is provided with flanges 66 on its opposite ends. The flanges 66 are spaced apart the same distance as flanges 56 so that the track 34 will fit between flanges 66 and roll along the bodies of the rollers 48.

In this manner, the tracks 34 are received on the rollers 48 and 50 in order to support the cover 22 for rolling movement along the top panel 16 of the container 10. The cover can roll on the rollers in a linear path carrying it between limiting positions wherein the cover is located adjacent the opposite sides 12 of the container. In the opposite limiting positions, the cover 22 is approximately centered over the adjacent side 12. The cover also has a position midway between its extreme positions in which the cover is centered above the opening 18, as best shown in FIG. 1. The cover 22 is larger than opening 18 and can be lowered from the FIG. 1 position to a closed position in which the opening 18 is sealed closed by the cover.

The angles 36 in each pair are provided with two pairs of aligned rectangular notches 68 (see FIG. 4 in particular) which extend upwardly into the angles from their lower edges. The notches 68 are spaced apart the same distance as the two intermediate rollers 50. The rollers and notches are located so that when the cover 22 is aligned above opening 18, the notches 68 are in registration with the underlying rollers 50. The notches 60 are at least as wide as the diameter of the body of each roller 50 so that the rollers can fit within the notches when the cover is lowered to close opening 18.

Each of the sliding plates 40 is provided with a pair of slots 70 which extend upwardly into the lower edge of the plate 40 at an incline and which terminate in semicircular bases 71 at their upper extremities. The configuration of each slot 70 is such that each plate 40 presents a projecting finger 72 which extends beneath the base portion 71 of each slot 70. The slots 70 are located such that when plate 40 is slid to one of its extreme positions (the position shown in FIG. 4) slot 70 is completely out of registration with the corresponding notches 68. Conversely, when plate 40 is slid to its other limiting position (the position shown in FIG. 3), each slot 70 registers and aligns with the corresponding pair of notches 68 in the angle members of the track. Each slot 70 is bounded at the top by an inclined edge 74 which provides a ramp surface along which roller 50 rides when the cover is being raised or lowered.

Sliding of the plates 40 back and forth between their limiting positions is effected by a pair of crank and screw actuating mechanisms, one of which is provided for each track 34. Each actuating mechanism includes an elongate horizontal rod 76 having a central externally threaded portion 78. Portion 78 of each rod is threaded through a lug 80 which projects from plate 40 through a horizontal slot 82 in one of the angles 36. The slot 82 is long enough to accommodate movement of plate 40 between its two limiting positions. A metal or plastic shield 83 (FIG. 2) preferably encloses the threads 83 and lug 80 in order to shield them from dirt and other contaminants. The shield 83 may be packed with grease. Each rod extends loosely through another pair of lugs 84 which project from angle member 36 near the opposite ends of slot 82. Each rod 76 also extends through and is pinned at 86 (FIGS. 3 and 4) to a pair of sleeves 88. Each sleeve 88 is fitted closely between a pair of bracket plates 90 extending from angle member 36, thus preventing rod 76 from moving axially. The sleeves 88 are able to freely turn between the bracket plates 90 so that rod 76 can be rotated about its axis, thereby sliding plate 40 back and forth depending upon the direction of rotation of the rod.

Figure 4:
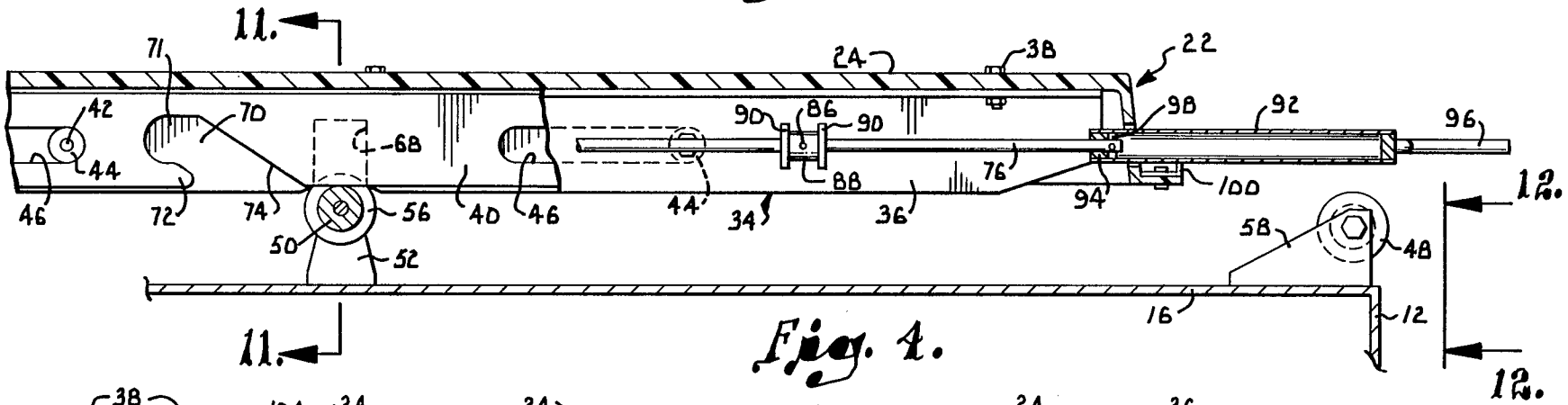
FIG. 4 is a fragmentary sectional view similar to FIG. 3, but showing the cover raised above the opening in the container, with portions broken away for purposes of illustration.

A crank mechanism is provided for each end of each rod 76. As best shown in FIG. 4, each crank mechanism includes a hollow barrel 92 carrying a notched bushing 94 in one end. The opposite end of each barrel 92 is provided with a crank handle 96 which can be manually operated to turn the barrel 92. The barrels 92 are fitted on the opposite ends of the rods 76. Each end of each rod 76 is provided with a cross pin 98 which is closely received in the notches in bushing 94 when the corresponding barrel 92 is pulled outwardly to the position shown in FIG. 4. Then, the crank is engaged with rod 76 so that upon operation of the crank handle 96, the rotation that is imparted to barrel 92 is transferred to rod 76. Consequently, when the crank is engaged, rotation of rod 76 in opposite directions can be effected by rotating the crank handle 96 in opposite directions. The cranks for each rod 76 are located adjacent to the opposite sides 12 of the waste container 10 so that the crank and screw mechanism can be operated from either side of the container.

Each crank can be disengaged from rod 76 by pushing the crank inwardly so that barrel 92 is retracted beneath the cover panel 24, as shown for the left hand barrel 92 in FIG. 2. This movement of barrel 92 causes the bushing 94 to disengage from the cross pin 98, thus allowing the cross pin to turn freely inside of the barrel. In the disengaged position of the crank, the crank handle 96 can be fitted in and retained by an angle member 100 which is carried on the outurned lip 28 on the lower edge of the cover 22.

When the cover 22 is moved to its fully open position, it can be tipped through a pivot arc of 90° and thereafter supported in suspension partially along the adjacent side 12 of the container 10. For support of the cover in its tipped or vertical position, a pair of opposing support bars 102 are provided adjacent to each of the tracks 34. The bars 102 in each pair oppose one another and are pivoted to a U-shaped bracket 104 mounted to the underside of the cover panel 24 immediately beyond the adjacent track 34. The bars 102 are generally centered relative to the width of the cover.

Figure 5:
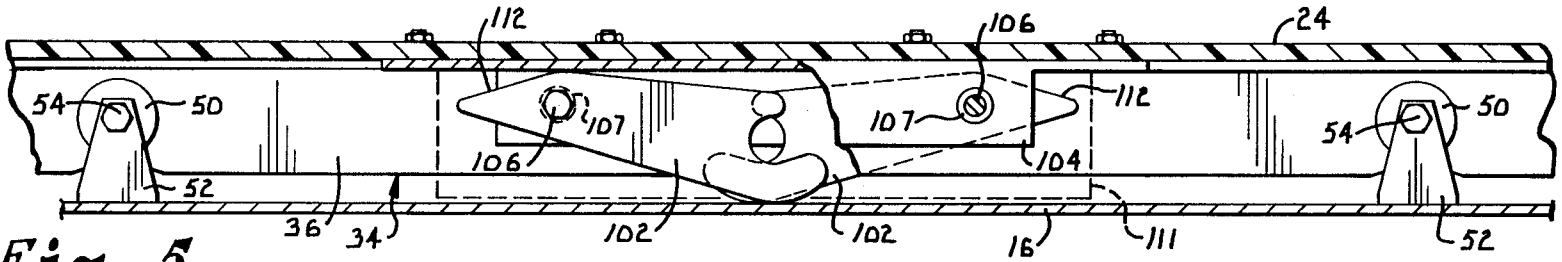
FIG. 5 is a fragmentary sectional view on an enlarged scale taken generally along line 5—5 of FIG. 1 in the direction of the arrows, with portions broken away for purposes of illustration.

Each bar 102 is pivotally connected with bracket 104 near one end of the bar. Horizontal rust proof bolts 106 and bronze bushings 107 (FIG. 5) provide the pivot connections between the bars 102 and brackets 104. Each bar 102 functions as a hook member and has a hook shaped free end presenting a semi-circular notch 108. A curved finger 110 projects beneath each notch 108 on the end of each bar 102. The weight of each bar 102 normally causes it to pivot downwardly about the axis of bolt 106 such that finger 110 rides on panel 16. The notches 108 in the bars in each par face in opposite directions and are aligned with the bushings 64. Each notch 108 is substantially the same size as the bushing 64. The pivoted end of each bar 102 takes the form of a heel which presents a flat edge 112 located adjacent the web portion of bracket 104. The bars 102 are preferably located within a shield 111 which is open at the bottom.

As shown in FIG. 1, the cover 22 is preferably provided with a pair of handles 113 near each side edge to facilitate handling of the cover. Mechanical latches 114 are also provided along each side edge of the cover for latching the cover down, as will be more fully described.

In use, cover 22 may be slid on rollers 48 and 50 from the position shown in FIG. 1 to a position adjacent either side 12 of the container 10. When the cover is positioned over opening 18, it can be lowered to a closed position to effect a tight seal around the opening 18.

Lowering of the cover to its closed position is effected by engaging either of the crank barrels 92 associated with each rod 76 and then turning the crank handle 96 in a direction to slide plate 40 until its slot 70 registers with the notches 68. As previously indicated, the two sets of notches 68 for each track 34 are aligned above the two intermediate rollers 50. As the crank handle 96 is turned in a direction to slide plate 40 to the right as viewed in FIG. 4, the inclined edges 74 come into contact with the bodies of rollers 50. As the slots 70 move into registration with notches 68, the cover 22 is gradually lowered and notches 68 gradually lower around the rollers 50 due to the incline of the edges 74. When plate 40 has been moved fully to the right in the position of FIG. 3, the base portions 71 of slots 70 are in full registration with rollers 50, and the rollers 50 fit within notches 68 and are closely received in the base portions 71 of slots 70. The fingers 72 project beneath the rollers 50 in order to latch the cover down on the opening 18.

When the cover is fully lowered to the closed position, the gasket 32 is compressed against tube 20, thereby effecting a continuous seal completely around opening 18 and preventing any of the contents of the waste container from leaking out past the cover. The seal also prevents moisture from leaking into the contents of the container. After the cover has been fully lowered to the closed position, the barrels 92 are preferably disengaged by pushing them inwardly and placing their crank handles 96 in the stored position where they are retained by angle member 100.

The container 10 can be transported or otherwise handled in a conventional manner with the cover 22 in its closed position. As previously indicated, a plurality of mechanical latches 114 (FIG. 1) are provided in order to latch the cover down in the closed position while the container is being transported from one site to another. The latches 114 are preferably of the type disclosed in U.S. Pat. No. 4,635,979 to Blume. This type of latching device can lay down flat when it is not in use, and the cover 22 can then roll over it as it approaches one side 12 or the other of the container.

The container 10 is typically a waste container of the type used to handle hazardous wastes such as toxic chemicals and the like. The container 10 may be transported on a truck bed or a railcar and may be transferred between trucks and railcars.

Figure 3:
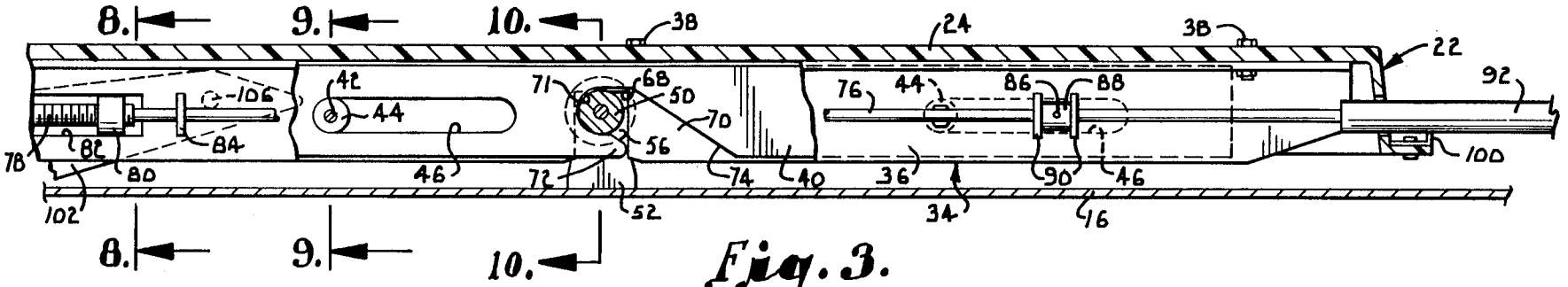
FIG. 3 is a fragmentary sectional view of the right half of the cover shown in FIG. 2 on an enlarged scale, with portions broken away for purposes of illustration.

In order to open the container 10, cover 22 is raised from the closed position shown in FIG. 3 to the open position shown in FIG. 4. This is accomplished by operating one of the crank handles 96 in a manner to move both plates 40 to the left as viewed in FIGS. 3 and 4. Again, the crank barrel 92 must be engaged with the pin 98 on the end of the rod before handle 96 can be operated to slide plate 40. When handle 96 is turned in the proper direction, the threaded engagement between lug 80 and the threaded portion 78 of the rod slides plate 40 to the left from the position shown in FIG. 3. This initially displaces the latching fingers 72 from beneath rollers 50 and subsequently causes the cover 22 to gradually ride upwardly as the inclined edges 74 are moved along the surfaces of rollers 50. When plate 40 has been moved far enough to move slots 70 out of registration with notches 68, the cover 22 is fully raised onto rollers 50, and each track 34 presents a continuous lower edge which rides along the rollers. After cover 22 has been fully raised to the open position, the cranks are preferably disengaged and stored on the angle member 100.

Figure 6:
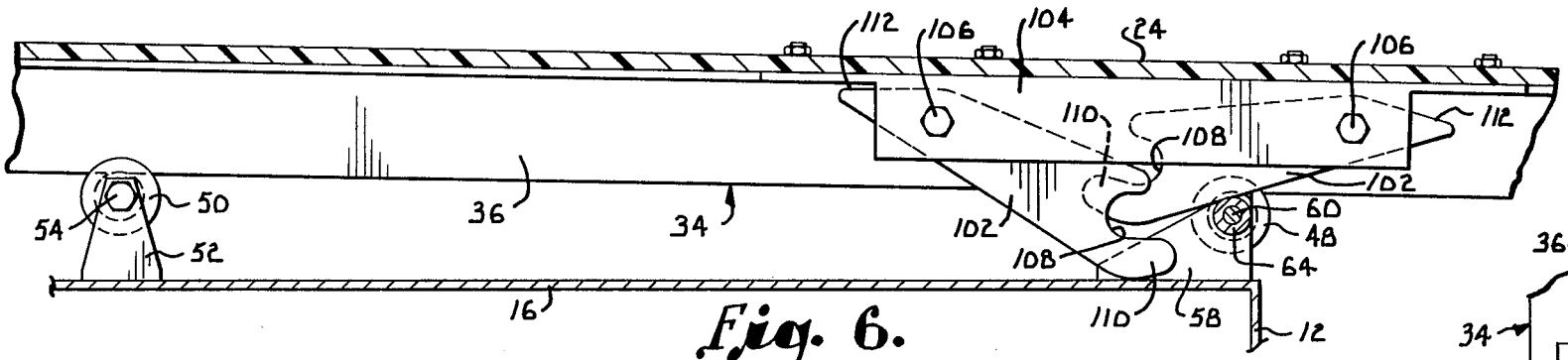
FIG. 6 is a fragmentary sectional view similar to FIG. 5, but showing the cover moved to a position adjacent one side of the container.

After the cover 22 has been raised above opening 18, it can thereafter be slid toward either of the sides 12 of the container 10. As the cover is manually rolled along the rollers, the fingers 110 of pivot bars 102 ride along the top panel 16 of the container. As the cover approaches one of the sides 12, the back edge of one of the pivot bars 102 engages the adjacent bushing 64 and is thereby pivoted upwardly, as shown in FIG. 6. The other pivot bar 102 approaches the bushing 64 with the notch 108 aligned with the bushing. As the cover reaches a position where its center is located adjacent to the side 12, notch 108 is received by the bushing 64. The cover 22 can then be pivoted or tipped about the horizontal axis of bushings 64 through a pivot arc of 90° from the position shown in FIG. 6 to the position of FIG. 7. In the FIG. 7 position, the cover assumes a substantially vertical orientation and is supported in extension partially along and above the side 12. The pivot bars 102 support the cover in this position and remain engaged with the bushing 64. It is noted that the projecting fingers 110 prevent the pivot bars 102 from sliding off of bushing 64 and thus possibly releasing the cover from the container. Also, edges 112 bear against the webs of brackets 104 to provide rigidity for holding the cover securely in place in its vertical position.

In this manner, the bushings 64 act as horizontal pins which provide pivot axes about which the cover can be tipped. The bushings 64 cooperate with the hook bars 102 in accommodating tipping of the cover and in supporting the cover in its vertical open position.

Figure 7:
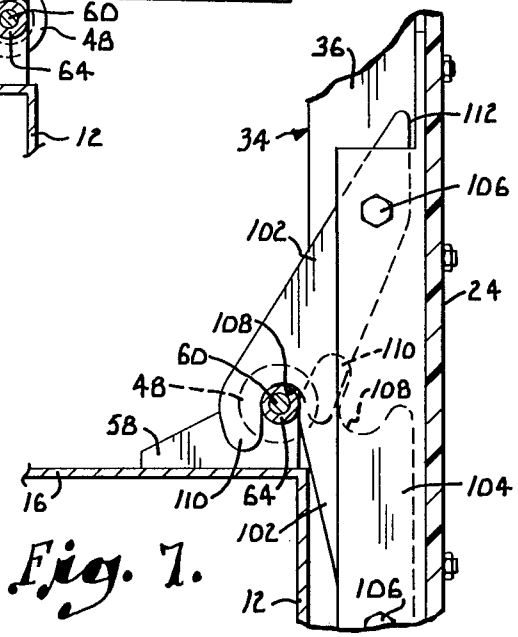
FIG. 7 is a fragmentary sectional view similar to FIG. 6, but showing the cover moved beyond the FIG. 6 position and pivoted to a vertical position extending partially along one of the sides of the container.

When the cover is in the fully opened position shown in FIG. 7, the opening 18 is fully exposed, and materials can be loaded into the container or unloaded from the container through the opening 18. A front end loader or similar equipment is normally used to load the materials and unload them.

At the end of the loading or unloading operation, the cover 22 can be pivoted from the vertical position of FIG. 7 to the horizontal position of FIG. 6, again through a pivot arc of 90°. It is noted that since the center of the cover is located adjacent to the side 12, the cover can be tipped rather easily between its horizontal and vertical positions with its weight helping the tipping motion.

Once the cover has been pivoted to the horizontal position shown in FIG. 6, it can be slid on rollers 48 and 50 until it is located above opening 18. Then, the cover can be lowered to the fully closed position in the manner described previously, and the contents of the container are again sealed within the container.

The container slides in a horizontal orientation along rollers 48 and 50 between the position of FIG. 1 and the limiting positions adjacent to the opposite sides of the container. It is only after the cover has reached the side of the container that the cover is tipped to the fully open position where the cover assumes a vertical orientation and the opening 18 is fully exposed for easy loading and unloading of the container.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. A cover construction for a bulk container having a side and a top presenting an opening, said cover construction comprising:

a cover panel having a size to cover the opening in the container;

track and roller means for supporting said cover panel on the top of said container in a manner allowing said cover panel to slide in a substantially horizontal orientation along the container top between a first position overlying the opening and a second position adjacent the side of the container;

means for selectively raising and lowering said cover panel in said first position thereof to respectively unseal the opening and seal the opening closed; and means for supporting said cover panel in a substantially vertical orientation extending partially along the side of the container in said second position of the cover panel, thereby allowing the cover panel to be tipped through a pivot arc of approximately 90° between horizontal and vertical orientations when the cover panel is in the second position, said supporting means comprising a rigid pin mounted on the container adjacent the side thereof with the pin axis in a substantially horizontal orientation and a hook member on the cover panel presenting a notch at a location to receive said pin in a manner allowing the hook member to pivot about the pin axis as the cover panel is tipped through said pivot arc.

2. The cover construction of claim 1, wherein said track and roller means comprises:

a pair of parallel tracks on said cover panel spaced apart from one another; and a plurality of rollers on the top of the container on which said tracks are received to support the cover panel for movement between the first and second positions thereof.

3. The cover construction of claim 2, wherein:

each track includes a pair of rails and a sliding plate connected between the rails in a manner to slide relative thereto, each pair of rails and the corresponding plate having adjacent lower edges;

said means for selectively raising and lowering said cover panel comprises aligned notch means in the lower edges of the rails in each pair arranged to register with the rollers in the first position of the cover panel and slot means in the lower edge of each sliding plate at a location to move into and out of registration with the notch means of the corresponding rails;

said notch means and slot means of each track are arranged to fit around said rollers in registration to lower the cover panel onto the opening from said first position; and said slot means includes an inclined edge effective to gradually lower the cover panel onto the opening as the slot means approaches registration with the notch means and to gradually raise the cover panel above the opening when the slot means moves out of registration with said notch means.

4. The cover construction of claim 3, including a finger on each sliding plate adjacent said slot means at a location to fit beneath a roller with which the slot means is aligned, thereby latching the cover panel down on the opening.

5. The cover construction of claim 3, including means for effecting sliding movement of each plate to bring the slot means into and out of registration with said notch means.

6. The cover construction of claim 5, wherein said means for effecting sliding movement of each plate comprises a rod having a threaded connection with said sliding plate, said rod being rotatable to effect reciprocation of the sliding plate by threaded action when the rod is turned in opposite directions.

7. The cover construction of claim 6, including:

a crank handle for said rod; and means for engaging said crank handle with said rod and disengaging the crank handle therefrom.

8. The cover construction of claim 1, including gasket means for sealing the cover panel around the opening when the cover panel is lowered onto the opening.

9. A cover construction for a bulk container having opposite sides and a top presenting an opening, said cover construction comprising:

a cover panel having a size to cover the opening in the top of the container;

a pair of parallel tracks on the cover panel spaced apart from one another;

a plurality of rollers on the top of the container arranged to receive said tracks in a manner to support said cover panel for linear movement in a path carrying the cover panel in a substantially horizontal orientation thereof between limiting positions adjacent the opposite sides of the container, said path carrying said cover panel over the opening in the container top;

means including an inclined surface on each of said tracks for selectively lowering said cover panel between respective open and closed positions thereof when the cover panel is positioned over the opening along said path, said cover panel being raised above the opening in the open position and being lowered onto the opening in the closed position with said inclined surfaces moving gradually upwardly and downwardly along said rollers as the cover panel moves between the open and closed positions;

releasable latch means fro latching said cover panel in the closed position; and means for permitting said cover panel to pivot through an arc of substantially 90° when the cover panel reaches either of its limiting positions and for supporting the cover panel in a substantially vertical orientation along side the corresponding side of the container after the cover panel has been pivoted through said arc.

10. The cover construction of claim 9, wherein said last named means comprises:

a pair of pins adjacent the opposite sides of the container, each pin defining a substantially horizontal pivot axis; and a pair of opposing hook members on the cover panel presenting notches therein facing the respective pins and located to receive the pins in the corresponding limiting positions of the cover panel, said notches and pins fitting in a manner to allow the hook members to pivot with the cover panel as the latter is pivoted through said arc and to thereafter support the cover panel in said vertical orientation.

11. The cover construction of claim 10, wherein:

each track is received on a pair of said rollers when the cover panel is located over the opening in the container;

each track includes a rail and a sliding plate connected to slide along the rail, each rail and plate having adjacent lower edges for riding on the rollers;

said lower edge of each rail includes a pair of notches aligned with the pair of rollers on which the corresponding track is received when the cover panel is located over the opening;

said lower edge of each plate includes a pair of slots arranged to move into and out of registration with the respective notches as the plate slides back and forth along the rail; and said means associated with said tracks for selectively raising and lowering said cover panel includes means for effecting sliding movement of said plates when the cover panel is located over the opening to move the slots out of registration with the notches and into registration with the notches, respectively, said notches and slots receiving the rollers when in registration to allow the cover panel to be lowered onto the opening.

12. The cover construction of claim 11, wherein said inclined surfaces comprise an inclined edge adjacent each slot for riding on the roller in a manner to gradually raise and lower the cover panel as the slots are moved out of and into registration with the notches, respectively.

13. The cover construction of claim 12, including a finger on each sliding plate projecting below each slot at a location to fit beneath the roller in the slot in a manner to latch the cover panel down on the opening in the container in the closed position of the cover panel.

14. The cover construction of claim 11, wherein said means for effecting sliding movement of said plates comprises a rod having a threaded connection with said sliding plate, said rod being rotatable to effect reciprocation of the sliding plate by threaded action when the rod is turned in opposite directions.

15. The cover construction of claim 14, including:

a pair of crank handles for each rod adjacent opposite ends thereof; and means for selectively engaging each crank handle with the adjacent end of the corresponding rod and disengaging the crank handle therefrom.

16. A cover construction for a waste container having a side and a top presenting an opening, said cover construction comprising:

a cover panel having a size to cover the opening in the top of the container;

roller means on the top of the waste container;

a pair of tracks on said cover panel engaged with said roller means in a manner supporting said cover panel for movement in a substantially horizontal orientation thereof between a first position overlying and spaced above the opening and a second position adjacent the side of the container, each track including a rail and a sliding plate connected to slide along the rail, each rail and sliding plate having adjacent lower edges which ride on said rollers;

notch means in the lower edge of each rail at a location to register with said roller means when the cover panel is in the first position thereof;

slot means in the lower edge of each sliding plate at a location to move into and out of registration with said notch means, said notch means and slot means fitting around said roller means when in registration to allow the cover panel to be lowered onto the opening from said first position;

releaseable latch means for latching said cover in sealed relationship to the opening;

means for selectively sliding each sliding plate to bring said slot means into and out of registration with said notch means, thereby allowing the cover panel to be lowered onto and raised above the opening; and means for supporting said cover panel adjacent the side of the waste container in a substantially vertical orientation of the cover panel wherein the cover panel is pivoted approximately 90° from its orientation in said second position.

17. The cover construction of claim 16, including an inclined edge adjacent said slot means for riding on said roller means in a manner to gradually raise and lower the cover panel as said slot means moves out of and into registration with said notch means.

18. The cover construction of claim 17, including a finger on each sliding plate projecting beneath said slot means at a location to fit beneath said roller means in a manner to latch the cover panel down on the opening when said slot means is in full registration with said notch means.

19. The cover construction of claim 16, wherein said means for supporting said cover panel adjacent the side of the waste container comprises:

a pin adjacent the side of the waste container; and a hook member on the cover panel, said hook member presenting a notch therein at a location to receive said pin in the second position of the cover panel, said notch and pin fitting together in a manner allowing the cover panel to be tipped from a substantially horizontal orientation in the second position to the substantially vertical orientation of the cover panel, with said hook member bearing against said pin in a manner to maintain and support the cover panel in said vertical orientation.

* * * * *